US011624599B2

(12) United States Patent
Ager

(10) Patent No.: US 11,624,599 B2
(45) Date of Patent: Apr. 11, 2023

(54) DYNAMIC HARDENED TARGET LAYER AND VOID DETECTOR SENSOR FOR USE WITH A WARHEAD OR PROJECTILE PENETRATOR

(71) Applicant: Instrumentation and Engineering Services, Inc., Navarre, FL (US)

(72) Inventor: Scott Alan Ager, Navarre, FL (US)

(73) Assignee: Instrumentation and Engineering Services, Inc., Navarre, FL (US)

( * ) Notice: Subject to any disclaimer, the term of this patent is extended or adjusted under 35 U.S.C. 154(b) by 33 days.

(21) Appl. No.: 17/323,352

(22) Filed: May 18, 2021

(65) Prior Publication Data

US 2021/0356242 A1 Nov. 18, 2021

Related U.S. Application Data

(60) Provisional application No. 63/026,211, filed on May 18, 2020.

(51) Int. Cl.
*F42C 1/10* (2006.01)
*F42B 12/20* (2006.01)

(52) U.S. Cl.
CPC ..... *F42C 1/10* (2013.01); *F42B 12/204* (2013.01)

(58) Field of Classification Search
CPC ..... F42C 1/10; F42C 1/12; F42C 1/00; F42C 1/02; F42C 1/04; F42C 1/06; F42C 1/08; F42C 1/09; F42C 1/14; F42C 7/00; F42C 7/02; F42C 7/04; F42C 7/06; F42C 7/12; F42C 5/00; F42B 12/204; G01L 1/22
(Continued)

(56) References Cited

U.S. PATENT DOCUMENTS 4,126,039 A * 11/1978 Smith ..... G01L 1/2262 73/167
5,157,221 A * 10/1992 Ronn ..... F42C 19/07 102/216

(Continued)

FOREIGN PATENT DOCUMENTS

WO WO-2020128453 A1 * 6/2020 ..... F42B 12/204

OTHER PUBLICATIONS

International Search Report and Written Opinion issued in PCT/US2021/032903, dated Mar. 1, 2022.

*Primary Examiner* — John Cooper
(74) *Attorney, Agent, or Firm* — Meunier Carlin & Curfman LLC

(57) ABSTRACT

Hardened target sensors and systems are described herein. An example system includes a projectile defining an ogive, a body, and a base. The body of the projectile is arranged between the ogive and the base. The system includes a sensor assembly including a nose member and a plurality of strain gauges. The nose member defines a nose portion, a shaft, portion, and a threaded portion. The strain gauges are attached to the shaft portion. The system includes a shroud member, which is mechanically coupled with the sensor assembly and the body. The system further includes a smart fuze arranged within the body. The smart fuze is operably coupled to the strain gauges. The strain gauges measure the compression/tension of the shaft portion, which is part of the nose member. The load measured by the strain gauges can be used to detect hardened target layers and/or voids.

29 Claims, 9 Drawing Sheets

(58) Field of Classification Search
USPC ..... 102/499; 73/88; 438/50
See application file for complete search history.

(56) References Cited

U.S. PATENT DOCUMENTS

| | | | | |
|---|---|---|---|---|
| 5,596,166 | A * | 1/1997 | Gould | F42B 12/08 102/284 |
| 5,705,766 | A * | 1/1998 | Farace | F42C 9/16 102/210 |
| 8,203,108 | B2 * | 6/2012 | Geswender | F42B 10/64 244/3.25 |
| 10,502,537 | B1 | 12/2019 | Sapp et al. | |
| 2004/0159261 | A1 * | 8/2004 | Steele | F42B 12/58 102/477 |
| 2008/0315032 | A1 * | 12/2008 | Harnoy | F42B 10/64 244/3.23 |
| 2010/0058946 | A1 * | 3/2010 | Geswender | F42C 19/02 102/206 |
| 2010/0107915 | A1 * | 5/2010 | Geswender | F42C 13/045 102/211 |

* cited by examiner

DYNAMIC HARDENED TARGET LAYER AND VOID DETECTOR SENSOR FOR USE WITH A WARHEAD OR PROJECTILE PENETRATOR

CROSS-REFERENCE TO RELATED APPLICATIONS

This application claims the benefit of U.S. provisional patent application No. 63/026,211, filed on May 18, 2020, and titled "DYNAMIC HARDENED TARGET LAYER AND VOID DETECTOR SENSOR FOR USE WITH A WARHEAD OR PROJECTILE PENETRATOR," the disclosure of which is expressly incorporated herein by reference in its entirety.

BACKGROUND

Ever since the military first developed hard target penetrators in World War II, the effectiveness of these munitions has been limited. The first fuzes developed for large bombs, to penetrate hardened targets, were "detonate on contact" devices. In such a "detonate on contact" device, the warhead would detonate on the surface of the target, leaving the buried bunkers relatively undamaged. This was basically a "dumb" warhead or munition. Such warheads are not effective against a bunker made of thick, reinforced concrete.

This limitation showed fuze designers the need for developing fuzes that could be programmed to delay detonating a warhead until it reached a desired depth, past the hardened concrete roof of a bunker. This delay scheme worked for simple buried targets but was still essentially a "dumb" fuze and required detailed knowledge of the target's thickness and its depth.

A "smart fuze" was then developed to intelligently decide when to detonate a warhead. The smart fuze attempted to detect the depth the hardened bunker was buried at before the smart fuze detonated the warhead.

It was soon discovered that although a smart fuze could be successfully designed for this purpose, it lacked the most important part to successfully implement this design: an accurate and cheap sensor for determining the environment the warhead was traveling through. For example, smart fuzes including accelerometer sensors, pressure sensors, and/or strain gauge sensors have been developed, but such sensors suffer from low survivability, high cost, and difficulty when installing. More importantly, these sensors have not provided reliable results in determining hard target layers and voids.

The sophistication of hardened targets (e.g., buried bunkers) has continually improved, but the sensor technology interfaced to "smart fuzes" has not kept up. Therefore, there exists a need for a cheap, easy to install, reliable sensor, interfaced with a "smart fuze", that can be used to determine hardened target layers and voids, and accurately detonate the warhead or projectile as required.

SUMMARY

Hardened target sensors and systems (e.g., munitions, projectiles, etc.) including hardened target sensors are described herein. In some implementations, a custom strain gauge sensor assembly is mounted inside the nose of a warhead, which turns a "dumb" munition into a "smart" munition. This sensor assembly can dynamically detect when a warhead enters and exits a hardened target layer, including sensing the voids between the target layers. More particularly, because the strain gauge sensor is mounted in the nose of a warhead, the sensor assembly can be used to instantly determine the dynamic loading forces acting on the nose of the warhead as the body of the munition begins to penetrate the hard target. Likewise, the strain gauge sensor can also instantly determine when this dynamic loading force is removed (or unloads) as the warhead exits the hard target. Furthermore, the strain gauge sensor can also measure the vibration frequencies in the penetrating body, indicating if the warhead is traveling through a void.

In addition, the individual strain gauge elements can be used to determine the "angle of attack" as the warhead penetrates a hard target by measuring the differences of the dynamic compression and tension loading on each individual strain gauges in the nose.

Mounted in the nose of the warhead, the strain gauge sensor provides low and high frequency dynamic loading information, which is then electrically integrated with smart fuze electronics, allowing the fuze to make an intelligent decision using a microprocessor, as to when and where to detonate the warhead.

In some implementations, the sensor assembly includes a hardened, exterior protective shroud, sealed with O-Rings, which provides protection to the strain gauge devices and wires from moisture and physical debris as the sensor travels through the hardened target. The nose portion is directly connected to the shaft, with the strain gauges mounted directly on the shaft. The multiple strain gauge devices are wired together as a Wheatstone bridge design, reducing electrical noise and allowing the sensor to determine the angle of impact with the hardened target by individually measuring the compression intention of each strain gauge. The strain gauge sensor can output either analog or digital sensor data.

Various implementations described herein include a system. In some implementations, the system includes a projectile defining an ogive, a body, and a base. The body of the projectile is arranged between the ogive and the base. The system also includes a sensor assembly, which includes a nose member and a plurality of strain gauges. The nose member defines a nose portion and a shaft portion. The strain gauges are attached to the shaft portion. The system also includes a shroud member, which is mechanically coupled with the sensor assembly and the body of the projectile. The system further includes a smart fuze arranged within the projectile. The smart fuze is operably coupled to the strain gauges.

In some implementations, the shaft portion is configured to compress in response to a load applied to the nose portion.

In some implementations, the shaft portion has a cylindrical, square, or multi-faceted shape.

In some implementations, the strain gauges are mounted to an external surface of the shaft portion.

In some implementations, the strain gauges are arranged in a spaced apart relationship circumferentially around the shaft portion.

In some implementations, the shroud member and the sensor assembly form a cavity therebetween, and the strain gauges are arranged in the cavity.

In some implementations, the system also includes a flexible sealing member configured to prevent debris and/or moisture present in an external environment from entering the cavity. The flexible sealing member is arranged in a gap between the shroud member and the sensor assembly. Optionally, the system includes at least one O-ring configured to prevent debris and/or moisture present in the external environment from entering the cavity. Optionally, the system includes a pair of O-rings.

In some implementations, each of the strain gauges is individually addressable.

In some implementations, the nose member includes a channel configured to route an electrical connector between a strain gauge and the smart fuze.

In some implementations, the sensor assembly includes a set of strain gauges configured as a bridge circuit. Optionally, the sensor assembly comprises a plurality of sets of strain gauges, each set of strain gauges being configured as the bridge circuit.

In some implementations, the shroud member includes a first bore. Additionally, the nose member includes a second bore. The smart fuze can be arranged at least partially within the first bore of the shroud member and/or the second bore of the nose member. Alternatively or additionally, the shroud member includes a first threaded portion disposed on an external surface of the shroud member and a second threaded portion disposed on an internal surface of the shroud member. The first threaded portion disposed on the external surface of the shroud member is configured to mechanically couple with a third threaded portion disposed on the projectile. Alternatively or additionally, the nose member further includes a fourth threaded portion. The fourth threaded portion of the nose member mechanically couples with the second threaded portion disposed on the internal surface of the shroud member.

In some implementations, the smart fuze includes a microprocessor. The microprocessor is configured to receive at least one signal detected by the strain gauges, analyze the at least one signal detected by the strain gauges, generate an actuation signal based, at least in part, on the analyzed at least one signal, and transmit the actuation signal to a detonator.

In some implementations, the step of analyzing the at least one signal detected by the strain gauges includes a time-domain analysis or a frequency-domain analysis.

In some implementations, the step of analyzing the at least one signal detected by the strain gauges includes determining a dynamic load acting on the projectile.

In some implementations, the step of analyzing the at least one signal detected by the strain gauges includes detecting an absence of the dynamic load acting on the projectile.

In some implementations, the step of analyzing the at least one signal detected by the strain gauges includes detecting compression and decompression cycles as the projectile passes through one or more hardened target layers.

In some implementations, the step of analyzing the at least one signal detected by the strain gauges includes counting a number of the one or more hardened layers through which the projectile passes.

In some implementations, the step of analyzing the at least one signal detected by the strain gauges includes determining an angle of attack of the projectile.

In some implementations, analyzing the at least one signal detected by the strain gauges includes analyzing a frequency domain of the at least one signal to determine a type of material through which the projectile passes.

In some implementations, the microprocessor is further configured to receive a respective signal detected by each of the strain gauges.

In some implementations, the projectile is a munition such as a bomb or a missile, for example.

Various other implementations described herein include a hardened target sensor. The hardened target sensor can be used with the projectile and/or smart fuze described herein. The sensor includes a sensor assembly, which includes a nose member and a plurality of strain gauges. The nose member defines a nose portion and a shaft portion, and the strain gauges are attached to the shaft portion. The sensor also includes a shroud member that is mechanically coupled with the sensor assembly.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1A:
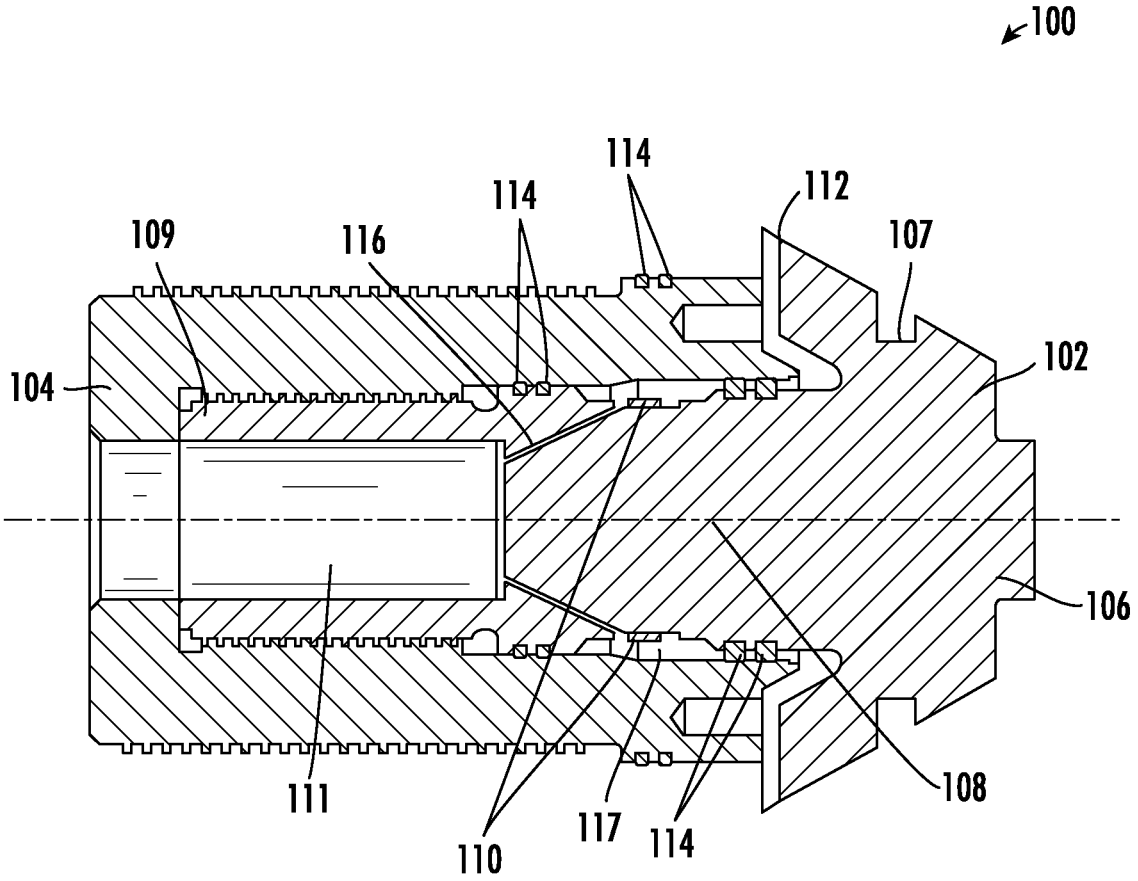
FIG. 1A shows a cross-sectional view of a hardened target sensor according to an implementation described herein.
Figure 1B:
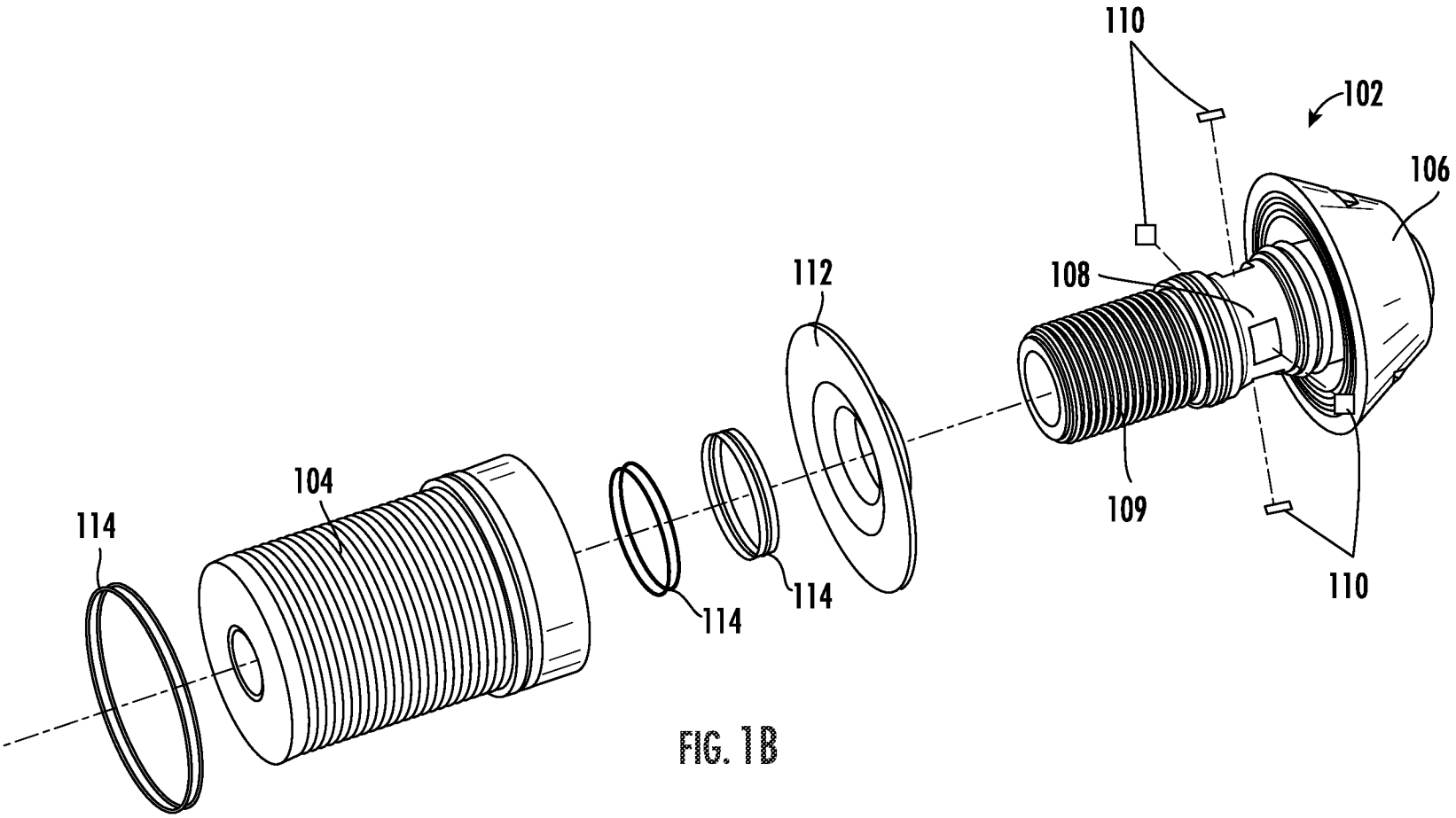
FIG. 1B shows an exploded perspective view of the hardened target sensor including the moisture proofing and anti-debris sealing elements.
Figure 1C:
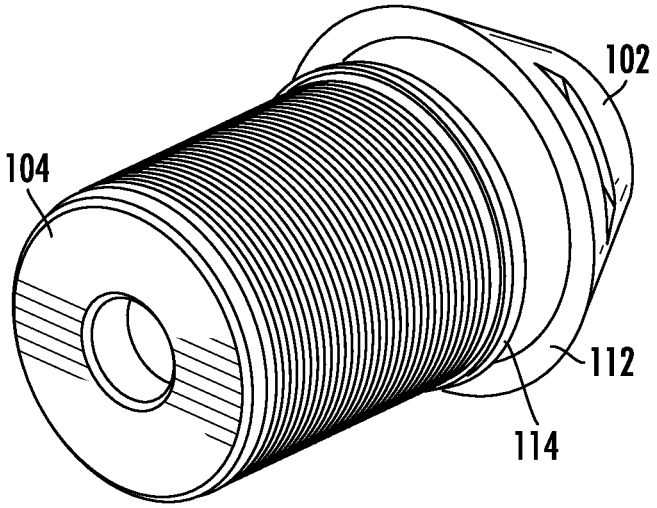
FIG. 1C shows a rear perspective view of the hardened target sensor.
Figure 1D:
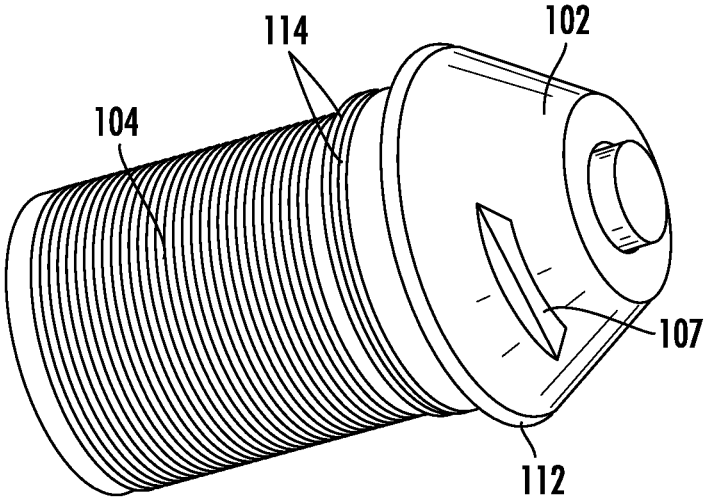
FIG. 1D shows a side perspective view of the hardened target sensor.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

An apparatus and system for dynamically detecting hardened target layers and voids are disclosed herein. In some implementations, the apparatus is mounted in the nose of a warhead or projectile and electrically coupled to a smart fuze.

The apparatus and systems described herein provide an inexpensive, fast acting, and reliable means to determine when a warhead or penetrator impacts and penetrates through a hardened target layer and/or void layer. By mounting strain gauges in the nose of a warhead, as the nose first impacts a hardened target, the dynamic compression load increases, resulting in the strain gauges measuring compression loading on the nose. This load compression remains until the nose of the warhead eventually penetrates (or stops in) the hardened target layer, and the dynamic loading on the strain gauges disappears. Because all these forces are acting on the nose of the warhead, the sensor described herein responds almost instantly to impact and penetration of the hardened target, and the sensor described herein ignores any type of body ringing in vibration or internal inside the warhead body or explosive fill material. The strain gauge sensor acts almost like an "on/off" switch, making it easy for a smart fuze to accurately determine when it penetrates a hard target layer with minimal computation power. Because this sensor is made up of strain gauges, it is inexpensive and resistant to outside electrical noise, high-frequency mechanical body vibrations, and temperature shifts. It does not rely on interpreting acceleration or vibration data to function. The mounting of the strain gauges on the shaft of the nose is not dependent on the warhead and can be done without the warhead body.

Another benefit is that for a successful operation, the projectile is not required to impact the target at zero-degree angle of attack. The sensor described herein is totally immune to impacting a target at different angles of attack. With the strain gauges configured in a full active Wheatstone bridge, and equally spaced and oriented around the shaft of the nose, the strain gauges can provide the magnitude value of the impact compression loading, ignoring any uneven loading on the nose of the warhead no matter what angle the warhead strikes the target at.

Another benefit is high-frequency noise data generated in the individual strain gauges by the dynamic stress/strain vibrations during the hardened target penetration event, can be used to indicate the type of target material the weapon is penetrating.

Because the strain gauges are mounted in a separate nose assembly, and not the warhead itself, they can be cheaply and reliably mounted in any warhead body and can be used with any style projectile or warhead.

FIGS. 1A-D show a hardened target sensor 100. The hardened target sensor 100 includes a sensor assembly and a shroud member 104. As described herein, the sensor assembly includes a nose member 102 and a plurality of strain gauges 110. This disclosure contemplates that the nose member 102 and the shroud member 104 can be made of a material that can survive impact and penetration of a hardened target, e.g., a metal, a metal alloy, a ceramic, or a combination thereof. In some implementations, the nose member 102 and the shroud member 104 are made of the same material. In other implementations, the nose member 102 and the shroud member 104 are made of different materials. Additionally, the nose member 102 has a nose portion 106, a shaft portion 108, and a threaded portion 109 (sometimes referred to herein as a "fourth threaded portion"). The nose portion 106 is the portion of the nose member 102 that is arranged at the tip of a warhead or projectile (e.g., projectile 400 shown in FIGS. 4A-B). In other words, the nose portion 106 is designed to impact the hardened target. The shaft portion 108 is disposed between the nose portion 106 and the threaded portion 109, which is arranged at the opposite end of the nose member 102 in relation to the nose portion 106. The nose portion 106, the shaft portion 108, and the threaded portion 109 are rigidly coupled such that a compression force acting on the nose portion 106 effects a compression force on the shaft portion 108. For example, a force acting on the nose portion 106 is transferred to the shaft portion 108 which is then transferred to the threaded portion 109. Optionally, the nose portion 106, the shaft portion 108, and the threaded portion 109 are different portions of an indivisible component, i.e., the nose member 102. For example, the nose member 102 can be a single, machined piece in some implementations. Optionally, in other implementations, one or more of the nose portion 106, the shaft portion 108, and/or the threaded portion 109 are distinct, separate components of the nose member 102.

It should be understood that the shape of the nose member 102 as shown in the figures are only provided as an example. This disclosure contemplates that the nose portion 106 can have a spherical, cylindrical, conical, or multi-faceted shape. In some implementations, the nose portion 106 has a truncated shape (e.g., frustoconical). Optionally, in some implementations, the nose portion 106 also includes at least one slot segment 107 formed in the nose portion 106. The slot segment 107 can be used to screw the hardened target sensor 100 into an applicable device such as a warhead or projectile (e.g., projectile 400 shown in FIGS. 4A-B). It should be understood that the size, shape, and/or arrangement of the slot segments 107 shown in the figures are provided only as examples. This disclosure contemplates that the size, shape, and/or arrangement of the slot segments 107 can be selected to accommodate machines and/or tooling used in the manufacturing process.

The shaft portion 108 and the threaded portion 109 of the nose member 102 extend away from the nose portion 106 with the shaft portion 108 being arranged between the threaded portion 109 and the nose portion 106. As described herein, the shaft portion 108 is configured to compress in response to a load applied to the nose portion 106. In particular, the shaft portion 108 is arranged in a cavity formed between the nose member 102 and shroud member 104. This permits compression of and/or tension in the shaft portion 108 as the nose portion 106 impacts and penetrates a hardened target layer. Such compression and/or tension is measured using strain gauges mounted on the shaft portion 108 as described herein. The cavity arranged around the shaft portion 108 (i.e., the region where the strain gauges are located) allows for free compression and tension movement. In some implementations, the shaft portion 108 and/or the threaded portion 109 are cylindrical. In other implementations, the shaft portion 108 and/or the threaded portion 109 have a square or multifaceted cross sectional shape. In yet other implementations, the shaft portion 108 and/or the threaded portion 109 are a contoured surface, such that the diameter is variable along the axial direction on the shaft portion 108 and/or threaded portion 109. The threaded portion 109 also has a bore 111 formed in a portion thereof (sometimes referred to herein as a "second bore"). Optionally, in some implementations, the bore 111 can extend at least partially into the shaft portion 108. The bore 111 does not extend entirely through the nose member 102. The bore 111 forms an internal volume, which, in some implementations, is sized to receive a smart fuze (e.g., smart fuze 402 shown in FIGS. 4A-B) at least partially therein. The threaded portion 109 has threads (e.g., helical structure configured to convert rotational to linear motion) disposed on an external surface of the threaded portion 109.

FIGS. 1A-D also show strain gauges 110 included in the hardened target sensor 100. The strain gauges 110 are attached to and/or embedded in the shaft portion 108. Strain gauges 110 can be attached to the shaft portion 108 with adhesive such as epoxy or other adhesive substance. Optionally, the strain gauges 110 can be coated with adhesive or epoxy to protect them from shock and/or vibration. In some implementations, the strain gauges 110 are secured circumferentially about the external surface of the shaft portion 108. The strain gauges 110 are spaced apart about the circumference of the shaft portion 108. In some implementations, the strain gauges 110 can include one or more sets of strain gauges, where each set of strain gauges includes two individual strain gauges oriented together, but rotated 90° from each other, and mounted on the same plane (see FIG. 3B). Optionally, the hardened target sensor can include four or more strain gauges (or four or more sets of strain gauges) equally spaced around the circumference of the shaft portion 108 (e.g., every 90 degrees or closer spacing). For example, a first set of two strain gauges can be located across from each other oriented on the +X and −X axis and a second set of two strain gauges can be located across from each other oriented on the +Y and −Y axis, where all four or more strain gauges are centered on a same Z axis plane. Alternatively or additionally, the strain gauges 110 can be arranged in a full or partial bridge circuit (e.g., Wheatstone bridge circuit) in some implementations.

FIGS. 1A-D also show a shroud member 104 included in the hardened target sensor 100. The shroud member 104 is a body which can be coupled to the nose member, e.g., via the threaded portion 109. Additionally, the shroud member 104 can be coupled to the warhead or projectile (e.g., projectile 400 shown in FIGS. 4A-B). As such, a force acting on the nose portion 106 is transferred to the shaft portion 108 which is then transferred to the threaded portion 109 which is then transferred to the shroud member 104 which is then transferred to the warhead or projectile. The shroud member 104 is therefore designed to mechanically interface with both the sensor assembly (i.e., nose member 102 and strain gauges 110) and the projectile and also provide protection for the delicate strain gauges (e.g., protection from moisture, fluid, high pressure, and/or blast debris). The shroud member 104 is described in further detail as shown in FIG. 2. As shown in FIGS. 1A-D, when the nose member 102 and the shroud member 104 are mechanically coupled, a cavity 117 is formed therebetween. The cavity 117 is arranged around the shaft portion 108 of the nose member 102. The strain gauges 110 are arranged in the cavity 117, which protects the strain gauges 110 from damage. The cavity 117 can be sized and/or shaped to prevent or minimize the likelihood of the strain gauges 110 sustaining physical damage as the nose member 102 impacts and traverses the hardened target. Additionally, the cavity 117 permits free compression of and/or tension in the shaft portion 108 as the nose portion 106 impacts and penetrates a hardened target. Such compression and/or tension is measured using the strain gauges 110.

In some implementations, the hardened target sensor 100 includes a flexible sealing member 112. The flexible sealing member 112 is disposed between the shroud member 104 and the nose member 102. The flexible sealing member 112 is arranged in a gap between the nose member 102 and the shroud member 104. The size and/or shape of the gap is designed to allow the nose member 102 to compress in relation to the warhead or projectile on impact with the hard target. The flexible sealing member 112 is configured to seal the surfaces between the nose member 102 and the shroud member 104. In some implementations the flexible sealing member 112 is made of a synthetic rubber (e.g., VITON FKM from The Chemours Co. of Wilmington, Del.), or any other suitable material. The flexible sealing member 112 is configured to prevent debris particles and/or moisture present in an external environment from entering the cavity 117 formed between the nose member 102 and the shroud member 104. For example, the flexible sealing member 112 can protect the shroud member 104 and/or the nose member 102 from being impacted by dislodged debris while penetrating a hardened target. Alternatively or additionally, the hardened target sensor 100 can optionally include one or more O-rings 114. Optionally, the hardened target sensor 100 includes one or more pairs of O-rings 114. For example, in FIG. 1A, the hardened target sensor 100 includes three pairs of O-rings 114. O-rings 114 are disposed at various locations between the shroud member 104 and the nose member 102. Similar to the flexible sealing member 112, the O-rings 114 are configured to prevent debris particles and/or moisture present in an external environment from entering the cavity 117 formed between the nose member 102 and the shroud member 104.

In some implementations, the strain gauges 110 are electromechanical sensors that change electrical characteristics (e.g., resistive value) dependent upon the amount of mechanical deformation (e.g., stain) that the sensor undergoes at a given time. Strain gauges are known in the art. Strain gauges include, but are not limited to, foil strain gauges and semiconductor strain gauges. For example, in some implementations, the strain gauges are load cell sensors used conventionally to measure the weight of large, heavy objects. This disclosure contemplates that the strain gauges 110 can be analog or digital sensors. In some implementations, the strain gauges 110 are a set of at least two or more strain gauges 110. Optionally, the strain gauges 110 are configured as a half or full Wheatstone bridge. Although four strain gauges 110 arranged as a Wheatstone bridge are provided as an example, this disclosure contemplates using other numbers and/or arrangements of strain gauges including, but not limited to, having more than one set of four strain gauges arranged in a bridge configuration. It should be understood that the strain gauges and/or configuration described above are only provided as examples. The disclosure contemplates that the hardened target sensor 100 can include solid state strain gauges, semiconductor strain gauges, nanoparticle-based strain gauges, linear strain gauges, membrane rosette strain gauges, double linear strain gauges, full bridge strain gauges, partial bridge strain gauges, shear strain gauges, half bridge strain gauges, column strain gauges, 45°-Rosette (3 measuring directions) strain gauges, 90°-Rosette (2 measuring directions) strain gauges, quartz crystal strain gauges, microscale strain gauges, piezo-resistant strain gauges, capacitive strain gauges, vibrating wire strain gauges, mercury-in-rubber strain gauges, fiber optic sensing strain gauges, or any other strain gauge, suitable to measure and transmit strain data. In some implementations the inner diameter of the shroud member 104 is spaced apart from the nose member 102 such that the cavity 117 is formed between the shroud member 104 and the nose member 102. The strain gauges 110 are disposed in the cavity 117, which allows unrestricted load compression and deformation when a dynamic load is applied on the nose member 102.

Figure 4A:
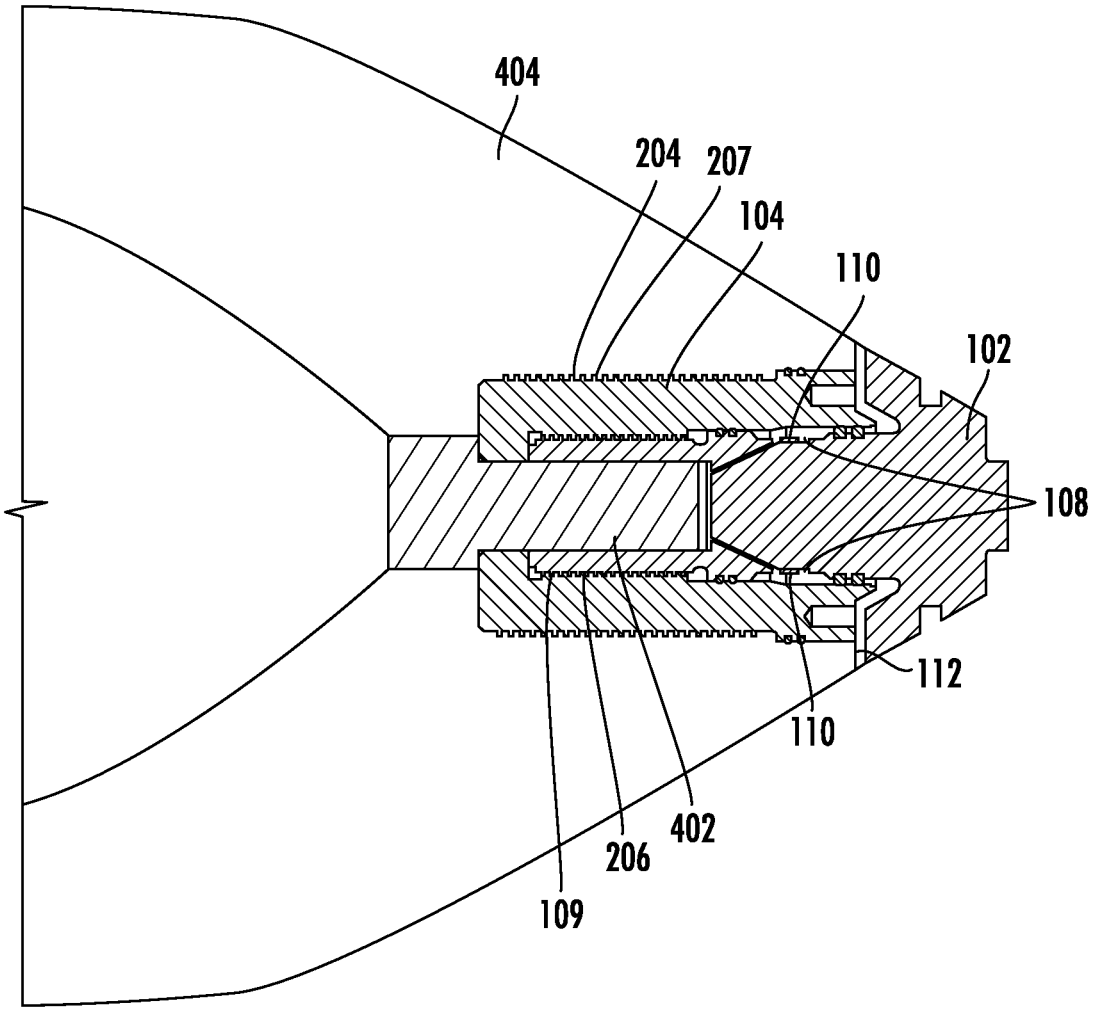
FIG. 4A shows a side cross-sectional view of the hardened target sensor coupled to a nose of a warhead.

As described herein, the strain gauges 110 are electrically coupled to a smart fuze (e.g., smart fuze 402 shown in FIG. 4A). The smart fuze is arranged in the body of the warhead or projectile (e.g., projectile 400 shown in FIGS. 4A-B). For example, each of the strain gauges 110 can be coupled to the smart fuze through a wire such that electrical signals are transmitted between the strain gauges 110 and the smart fuze. The wire can be arranged in a channel 116 provided in the nose element 102. It should be understood that the size, shape, and/or arrangement of the channels 116 shown in the figures are provided only as examples. In some implementations, the strain gauges 110 and/or coupling wires can be encapsulated, for example, by a protective coating, to provide a protective barrier over the strain gauges 110 and wires. The coating stabilizes the strain gauges 110 and wires from high shock and vibration forces. For example, strain gauges 110 and wires can be encapsulated by any epoxy material compound. Additionally, although a wire is provided as an example, this disclosure contemplates that the strain gauges 110 can be coupled to the smart fuze though one or more communication links. This disclosure contemplates the communication links are any suitable communication link. For example, a communication link may be implemented by any medium that facilitates exchange of signals including, but not limited to, wired, wireless and optical links. When the hardened target sensor 100 is impacted, for example, as the warhead or projectile (e.g., projectile 400 shown in FIGS. 4A-4B) begins to penetrate a hardened target layer, load is transferred to the shaft member 108 and it compresses, causing dynamic compression loading. The strain gauges 110 measure such dynamic compression loading as the nose member 102 is mechanically compressed underload. As the nose member 102 passes through the hardened target layer into a void layer, the shaft member 108 decompresses (e.g., returns to its original state) and the strain gauges 110 measure the absence of the compression loading. The strain gauges 110 are capable of measuring dynamic compression loading and decompression nearly instantaneously. As described above, the strain gauges 110 pass this information to the smart fuze. It should be understood that this dynamic compression and decompression cycle is repeated each time the projectile penetrates through a new hardened target layer. Accordingly, the smart fuze can be configured to accurately determine exactly when to detonate the explosives based on the number of hardened target layers through which the projectiles passes and/or the number of void layers.

In some implementations, the strain gauges 110 are individually addressable, such that each strain gauge 110 can transmit an electrical signal independent of any other strain gauge to the smart fuze. As such, each strain gauge 110 can be accessed separately by a microprocessor. The individual addressability of the strain gauges 110 allows the strain gauges 110 to transmit distinct electrical signals as each is affected by separate loads, angles, and times of impact when impacted in implementations where integrated with a warhead or other projectile as illustrated in FIGS. 4A-B.

FIG. 2 shows a detailed cutaway view of the shroud member 104. The shroud member 104 has a first end 104*a*, a second end 104*b*, an internal surface 104*c*, and an external surface 104*d*. The shroud member 104 has a hollow channel or bore 202 (sometimes referred to herein as a "first bore"). The bore 202 forms an internal volume, which, in some implementations, is sized to receive a smart fuze (e.g., smart fuze 402 shown in FIGS. 4A-B) at least partially therein at one end and the nose member 102 at the other end. The bore 202 extends entirely through the shroud member 104. As shown in FIG. 2, the size of the bore 202 can optionally vary along the axial direction of the shroud member 104, e.g., the diameter is different at the first and second ends 104*a* and 104*b*, respectively. In some implementations, the shroud member 104 includes a first threaded portion 204 having threads (e.g., helical structure configured to convert rotational to linear motion) disposed on the external surface 104*d* of the shroud member 104 and a second threaded portion 206 having threads (e.g., helical structure configured to convert rotational to linear motion) disposed on the internal surface 104*c* of the shroud member 104. In some implementations, the first threaded portion 204 is configured to mechanically couple with a threaded portion 207 (sometimes referred to herein as a "third threaded portion") of a warhead or projectile (e.g., projectile 400 shown in FIGS. 4A-B), and the second threaded portion 206 is configured to mechanically couple with a threaded portion disposed on an external surface of a nose member (e.g., the threaded portion 109 shown in FIG. 1A). Additionally, as described above, the size of the bore 202 can vary along the axial direction of the shroud member 104, including in a region where the cavity 117 between the shroud member 104 and the nose member is arranged. This variation in inner diameter of the bore 202 allows the shroud member 104 to couple to the shaft of the nose member while retaining a protective air void positioned around the strain gauges to ensure there is no mechanical interference with the strain gauges as described above. In some implementations, the shroud member 104 optionally includes a protective flashing 208. The protective metal flashing 208 provides additional protection for the strain gauges arranged in the cavity 117, as the protective flashing 208 is shaped to deflect debris from entering the hardened target sensor. In some implementations, the shroud member 104 optionally includes one or more tooling holes 210, which provide a connection for tooling used to install the shroud member 104. The tooling holes 210 are formed to receive an installation tool for installing the shroud into a threaded receiver. Although the implementation shown in FIG. 2 has four tooling holes 210, any number of tooling holes 210, appropriate for screwing a shroud into a threaded receiver, can be used. Additionally, this disclosure contemplates that the size, shape, and/or arrangement of the tooling holes 210 may be different from the example shown in FIG. 2.

Figure 3A:
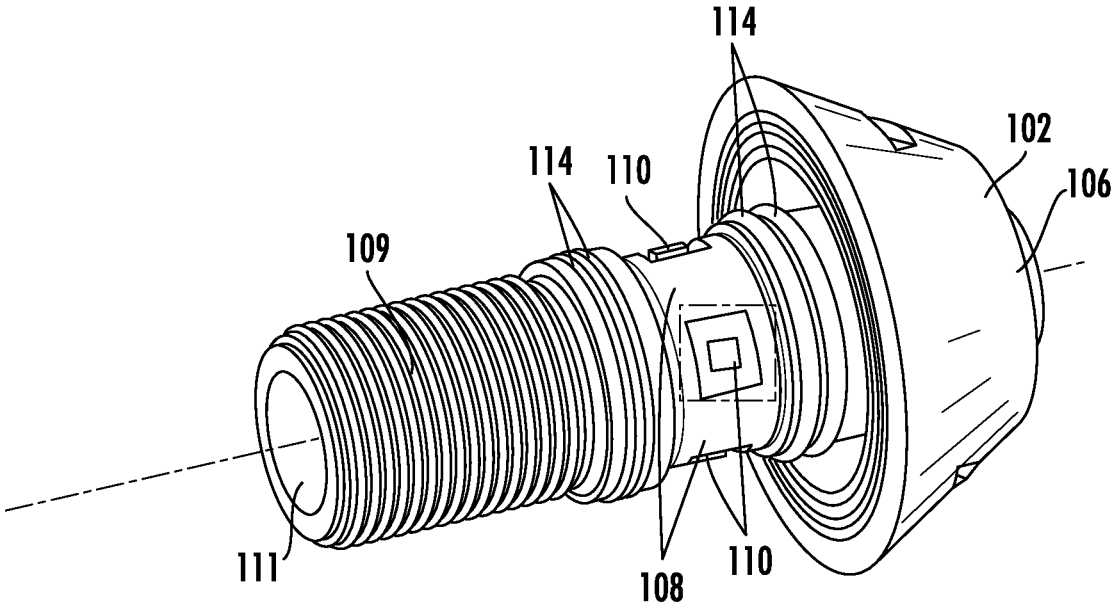
FIG. 3A shows a side perspective view of a sensor assembly of the hardened target sensor.
Figure 3B:
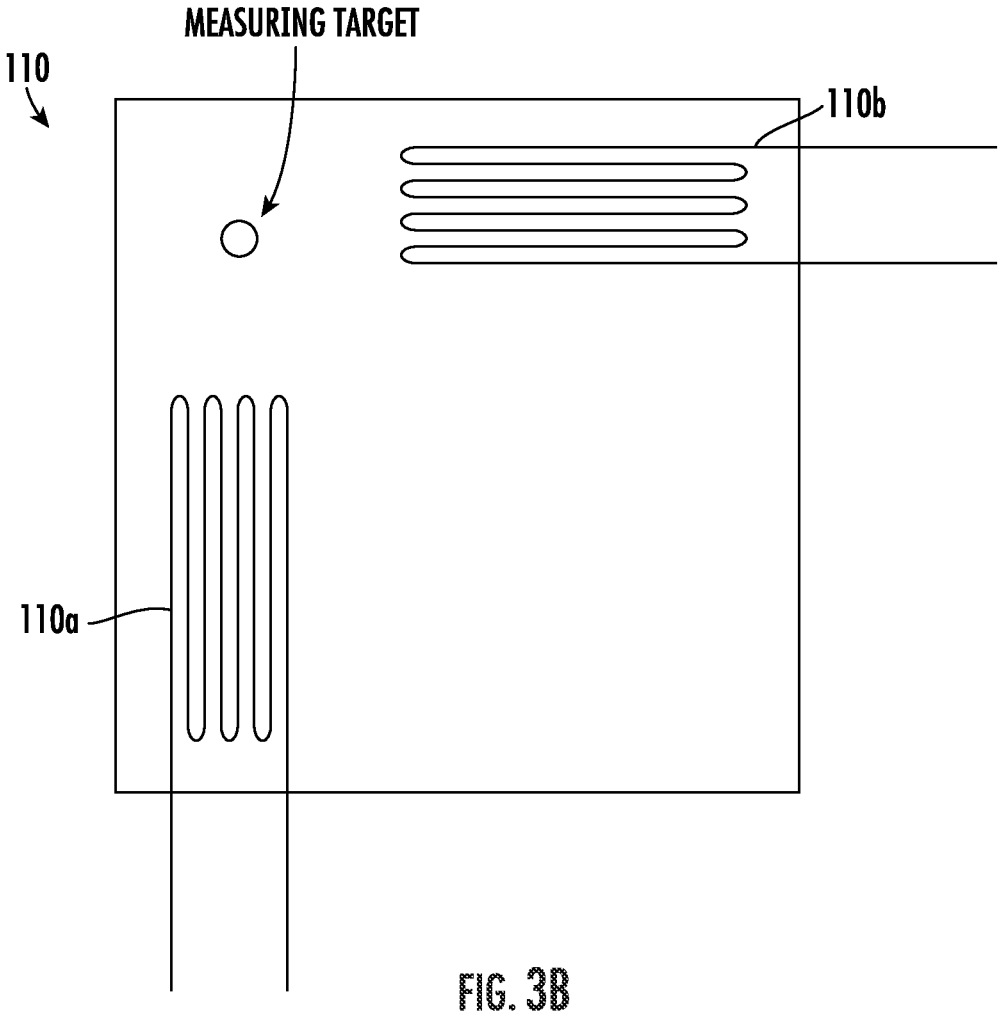
FIG. 3B shows a detailed view of a pair of strain gauges in the sensor assembly of the hardened target sensor of FIG. 3A.

FIGS. 3A and B shows the sensor assembly (e.g., the nose member 102 and strain gauges 110) of the hardened target sensor 100. As described herein, the nose member 102 includes the nose portion 106, the shaft portion 108, and the threaded portion 109. The strain gauges 110 are attached to an external surface of the shaft portion 108, e.g., in a spaced apart relationship circumferentially around the shaft portion 108. In FIG. 3A, the sensor assembly includes four sets of strain gauges 110, where two sets of strain gauges are located across from each other oriented on the +X and −X axis and two sets of strain gauges are located across from each other oriented on the +Y and −Y axis. Each set of strain gauges includes two strain gauges oriented together, but rotated 90° from each other in a half Wheatstone bridge configuration. For example, each of the strain gauges 110 shown in FIG. 3A is a pair of strain gauges. FIG. 3B is a detail view of the pair of strain gauges shown in the dotted box in FIG. 3A. Strain gauges 110*a*, 110*b* in FIG. 3B are oriented together, but rotated 90° from each other as a half Wheatstone bridge. All of the strain gauges 110 in FIG. 3A are centered on a same Z axis plane. Although examples are provided with multiple strain gauges at each location, this disclosure contemplates that the sensor assembly can include one or more strain gauges at each location. In other words, it should be understood that the strain gauge configurations shown in FIGS. 3A and 3B are provided only as examples. This disclosure contemplates that the strain gauge configuration may be different than shown in the figures. Alternatively or additionally, the sensor assembly can include more or less than four strain gauges 110. The bore 111 is also shown in FIG. 3A. In addition, as shown in FIG. 3A, the nose member 102 optionally includes at least one O-ring 114 that is coupled to the external surface of the shaft portion 108. The at least one O-ring 114 prevents unwanted moisture, impact pressure, and debris from entering the cavity (not shown in FIG. 3A) of the hardened target sensor. In some implementations, the sensor assembly includes a pair of O-rings 114 (e.g., two pairs of O-rings shown in FIG. 3A). Similar to the flexible sealing member 112 discussed above, the at least one O-ring 114 is made of a synthetic rubber, or any material suitable for sealing a hardened target sensor.

Figure 4B:
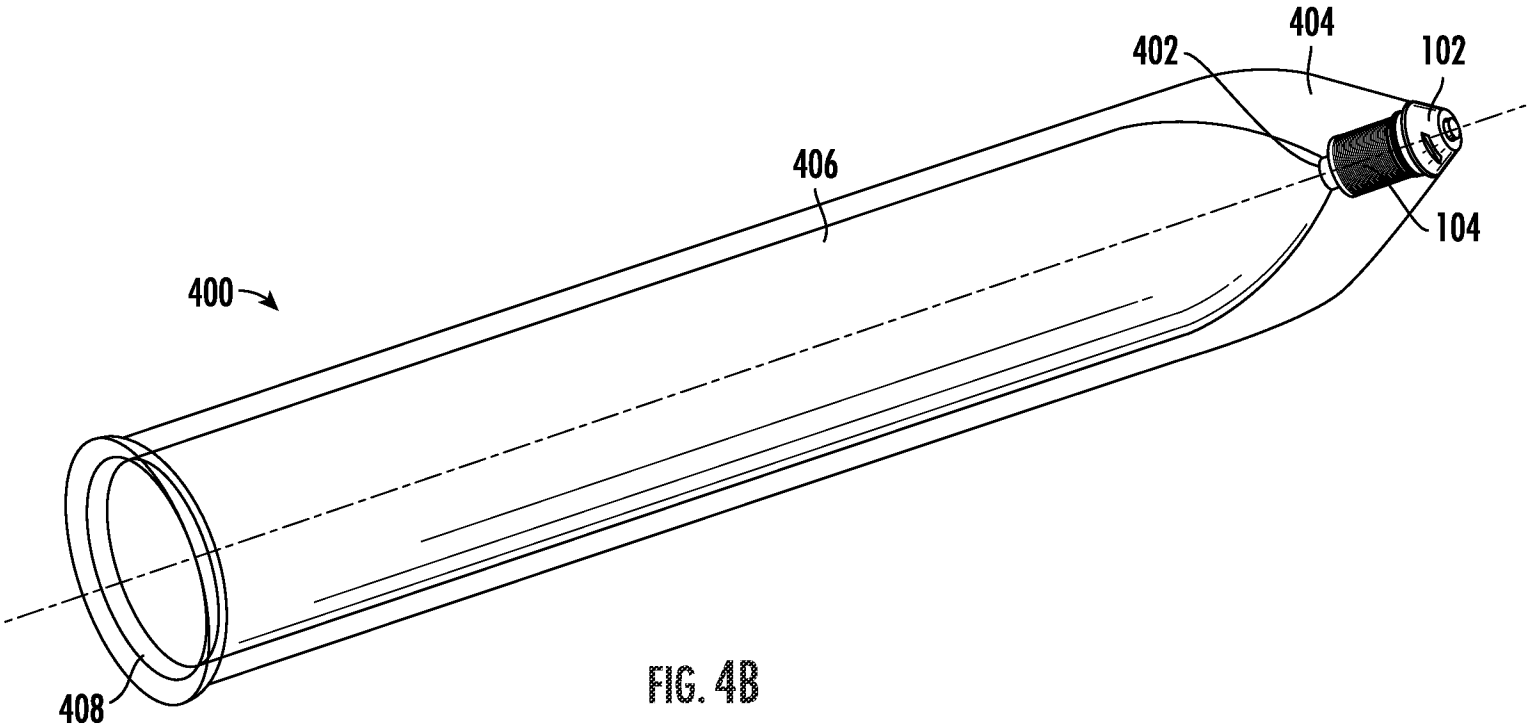
FIG. 4B shows a perspective view of the hardened target sensor coupled to a warhead.

FIGS. 4A-4B show a hardened target sensor 100 coupled to a projectile. The system includes a projectile 400, a hardened target sensor, and a smart fuze 402. As described above with regard to FIGS. 1A-3B, the hardened target sensor includes the nose member 102, the strain gauges 110, and the shroud member 104. The flexible sealing member 112 is arranged in a gap between the nose member 102 and the shroud member 104, sealing the strain gauges 110 in a cavity. The strain gauges 110 are arranged on the shaft portion 108 of the nose member 102. The smart fuze 402 is arranged in the projectile 400 (e.g., arranged within an internal portion of the projectile 400) and is configured to generate the detonation signal. As shown in FIG. 4A, the smart fuze 402 is optionally partially disposed within the bore of the nose member 102 (e.g., bore 111 shown in FIGS. 1A and 3A) and/or the bore of the shroud member 104 (e.g., bore 202 shown in FIG. 2). The projectile 400 defines an ogive 404, a body 406, and a base 408. The body 406 is arranged between the ogive 404 and the base 408. This disclosure contemplates that the projectile 400 is a munition such as a bomb or missile. In some implementations, a threaded portion of the shroud member 104 (e.g., the first threaded portion 204 shown in FIG. 2) securely couples the hardened target sensor 100 to the body 406. For example, a corresponding threaded portion having threads (e.g., helical structure configured to convert rotational to linear motion) can be provided on the body 406 (e.g., the third threaded portion described herein). As such, a force acting on the nose member 102 is transferred to the shaft portion 108 which is then transferred to the shroud member 104 which is then transferred to the projectile 400. It should be understood that the projectile 400 shown in FIGS. 4A-4B is provided only as an example. This disclosure contemplates that the hardened target sensor described herein can be attached to a munition, bomb, missile, or penetrator having other shapes and/or sizes than shown in FIGS. 4A-4B.

The smart fuze 402 is capable of activating a detonator for detonating an explosive, which can be included in the projectile 400. Smart fuzes are known in the art. For example, the smart fuze 402 includes a processor that is capable of sending, receiving, and processing electrical signals such as the signals detected by the strain gauges. This disclosure contemplates that the smart fuze 402 includes a microprocessor. A microprocessor includes the basic computing device configuration illustrated in FIG. 5 by dashed line 502, i.e., at least a processor and memory. This disclosure contemplates that the microprocessor can be programmed to perform the operations described herein. The microprocessor can be configured to receive at least one signal detected by the strain gauges described herein. For example, in some implementations, dynamic compression data from the strain gauges is relayed through electrical signals to the smart fuze 402. The microprocessor can optionally receive and process a plurality of separate signals from individually addressable strain gauges as described above. The microprocessor can detect the separate signals from the strain gauges and analyze the electrical signals to determine a time of detonation. In some implementations, the smart fuze 402 generates a detonation or actuation signal based, at least in part, on the analysis of the at least one electrical signal. The detonation or actuation signal is transmitted from the smart fuze 402 to a detonator, which is part of the projectile 400.

Referring again to FIGS. 1A-3B, the strain gauges 110 are disposed about the shaft portion 108. If the nose member 102 impacts a hardened target directly perpendicularly (i.e., at a 0° angle of attack), then all of the strain gauges 110 positioned around the shaft portion 108 detect compression equally. But, if the nose member 102 impacts the hardened target at an angle (i.e., an angle other than 0° angle of attack), then the strain gauges 110 positioned around the shaft portion 108 detect compression and tension differently, depending on the angle of impact of each strain gauge with respect to the hardened target. The smart fuze (e.g., smart fuze 402 of FIGS. 4A-4B) can use this information to determine at what angle and direction the projectile has impacted the hardened target by comparing the stress versus strain load at each strain gauge. Additionally, in implementations where the strain gauges form a Wheatstone bridge, the respective compression and tension detected by the strain gauges 110 is combined to provide an overall magnitude of the compression loading on the nose member 102.

In some implementations, as the nose member 102 begins to penetrate a hardened target, the strain gauges 110 measure dynamic compression acting on the shaft portion 108. The strain gauges 110 electrically transmit the dynamic compression measurement to the smart fuze. Dynamic compression ceases to act on the nose member 108 once the nose member 108 penetrates the hardened target. This cessation of dynamic compression causes the shaft portion 108 to return back to its original position. This dynamic compression and decompression cycle is repeated each time the hardened target sensor 100 penetrates through a new hardened target layer. The strain gauges 110 provide compression data to the smart fuze during each compression cycle, and stop transmitting data during each decompression cycle. In implementations where the hardened target sensor 100 is coupled to a warhead, the smart fuze processes the dynamic compression measurements to determine whether it is still penetrating additional hardened target layers. If the smart fuze determines that it is no longer penetrating hardened target layers, the smart fuze sends a detonation signal to a detonator. Alternatively or additionally, a frequency of the signal detected by the strain gauges 110 can also be used to determine the type and hardness of a hardened target. Analyzing the frequency of vibrations generated as the projectile 400 penetrates a target allows the smart fuze to determine the types of layers through with the projectile travels. This disclosure contemplates that the smart fuze can use various processing techniques once it receives the electrical signals from the at least one strain gauges. For example, the smart fuze can analyze the at least one signal detected by the strain gauges 110 by using a time-domain analysis or a frequency-domain analysis to determine a dynamic load acting on the projectile and/or an angle of attack.

It should be appreciated that the logical operations described herein with respect to the various figures may be implemented (1) as a sequence of computer implemented acts or program modules (i.e., software) running on a computing device (e.g., the computing device described in FIG. 5), (2) as interconnected machine logic circuits or circuit modules (i.e., hardware) within the computing device and/or (3) a combination of software and hardware of the computing device. Thus, the logical operations discussed herein are not limited to any specific combination of hardware and software. The implementation is a matter of choice dependent on the performance and other requirements of the computing device. Accordingly, the logical operations described herein are referred to variously as operations, structural devices, acts, or modules. These operations, structural devices, acts and modules may be implemented in software, in firmware, in special purpose digital logic, and any combination thereof. It should also be appreciated that more or fewer operations may be performed than shown in the figures and described herein. These operations may also be performed in a different order than those described herein.

Figure 5:
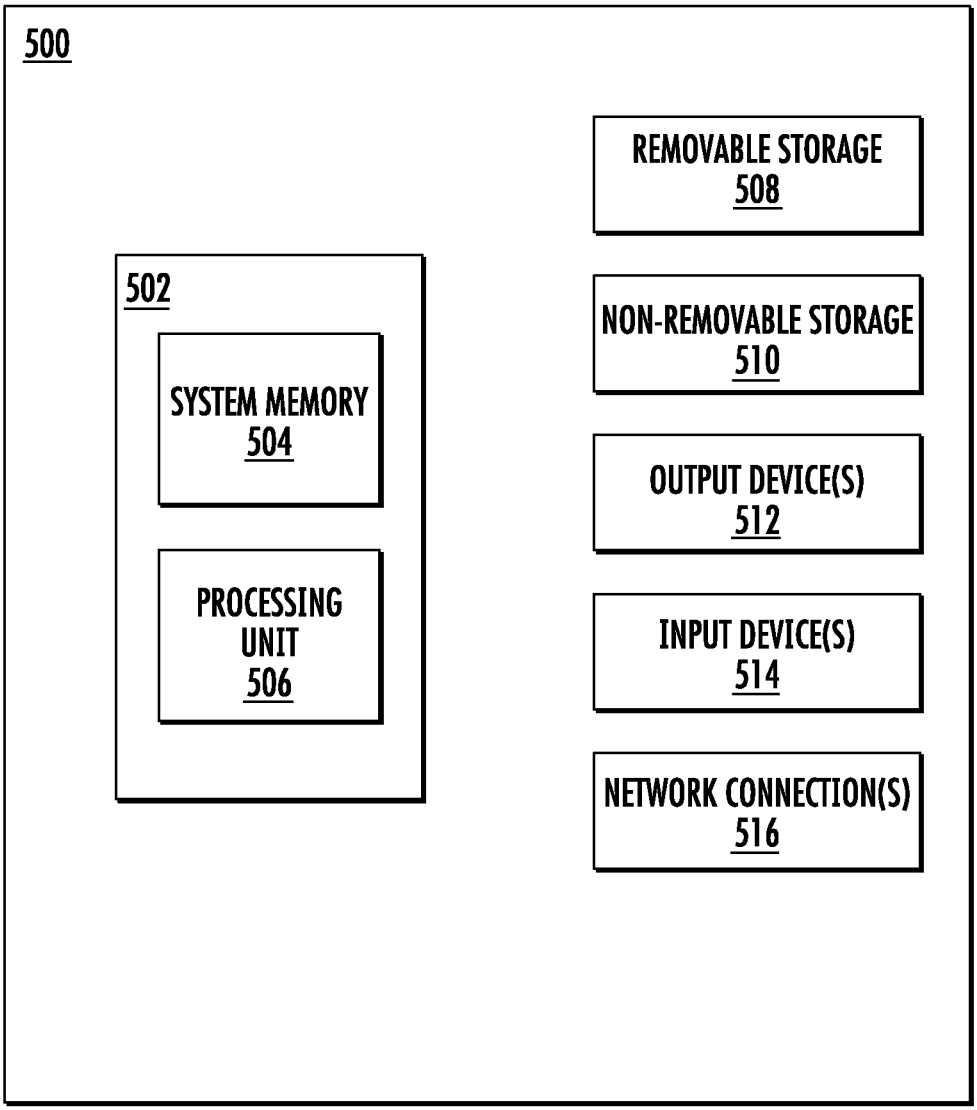
FIG. 5 is an example computing device.

Referring to FIG. 5, an example computing device 500 upon which the methods described herein may be implemented is illustrated. It should be understood that the example computing device 500 is only one example of a suitable computing environment upon which the methods described herein may be implemented. As described above, this disclosure contemplates that the smart fuze can include a microprocessor. Such a microprocessor can be made durable and/or protected to handle the high shock and vibration generated upon impact with a hardened target. Optionally, the computing device 500 can be a well-known computing system including, but not limited to, personal computers, servers, handheld or laptop devices, multiprocessor systems, microprocessor-based systems, network personal computers (PCs), minicomputers, mainframe computers, embedded systems, and/or distributed computing environments including a plurality of any of the above systems or devices. Distributed computing environments enable remote computing devices, which are connected to a communication network or other data transmission medium, to perform various tasks. In the distributed computing environment, the program modules, applications, and other data may be stored on local and/or remote computer storage media. As described above, this disclosure contemplates that the smart fuze can include a microprocessor.

In its most basic configuration, computing device 500 typically includes at least one processing unit 506 and system memory 504. Depending on the exact configuration and type of computing device, system memory 504 may be volatile (such as random access memory (RAM)), non-volatile (such as read-only memory (ROM), flash memory, etc.), or some combination of the two. This most basic configuration is illustrated in FIG. 5 by dashed line 502. The processing unit 506 may be a standard programmable processor that performs arithmetic and logic operations necessary for operation of the computing device 500. The computing device 500 may also include a bus or other communication mechanism for communicating information among various components of the computing device 500.

Computing device 500 may have additional features/functionality. For example, computing device 500 may include additional storage such as removable storage 508 and non-removable storage 510 including, but not limited to, magnetic or optical disks or tapes. Computing device 500 may also contain network connection(s) 516 that allow the device to communicate with other devices. Computing device 500 may also have input device(s) 514 such as a keyboard, mouse, touch screen, etc. Output device(s) 512 such as a display, speakers, printer, etc. may also be included. The additional devices may be connected to the bus in order to facilitate communication of data among the components of the computing device 500. All these devices are well known in the art and need not be discussed at length here.

The processing unit 506 may be configured to execute program code encoded in tangible, computer-readable media. Tangible, computer-readable media refers to any media that is capable of providing data that causes the computing device 500 (i.e., a machine) to operate in a particular fashion. Various computer-readable media may be utilized to provide instructions to the processing unit 506 for execution. Example tangible, computer-readable media may include, but is not limited to, volatile media, non-volatile media, removable media and non-removable media implemented in any method or technology for storage of information such as computer readable instructions, data structures, program modules or other data. System memory 504, removable storage 508, and non-removable storage 510 are all examples of tangible, computer storage media. Example tangible, computer-readable recording media include, but are not limited to, an integrated circuit (e.g., field-programmable gate array or application-specific IC), a hard disk, an optical disk, a magneto-optical disk, a floppy disk, a magnetic tape, a holographic storage medium, a solid-state device, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices.

In an example implementation, the processing unit 506 may execute program code stored in the system memory 504. For example, the bus may carry data to the system memory 504, from which the processing unit 506 receives and executes instructions. The data received by the system memory 504 may optionally be stored on the removable storage 508 or the non-removable storage 510 before or after execution by the processing unit 506.

It should be understood that the various techniques described herein may be implemented in connection with hardware or software or, where appropriate, with a combination thereof. Thus, the methods and apparatuses of the presently disclosed subject matter, or certain aspects or portions thereof, may take the form of program code (i.e., instructions) embodied in tangible media, such as floppy diskettes, CD-ROMs, hard drives, or any other machine-readable storage medium wherein, when the program code is loaded into and executed by a machine, such as a computing device, the machine becomes an apparatus for practicing the presently disclosed subject matter. In the case of program code execution on programmable computers, the computing device generally includes a processor, a storage medium readable by the processor (including volatile and non-volatile memory and/or storage elements), at least one input device, and at least one output device. One or more programs may implement or utilize the processes described in connection with the presently disclosed subject matter, e.g., through the use of an application programming interface (API), reusable controls, or the like. Such programs may be implemented in a high level procedural or object-oriented programming language to communicate with a computer system. However, the program(s) can be implemented in assembly or machine language, if desired. In any case, the language may be a compiled or interpreted language and it may be combined with hardware implementations.

Figure 6:
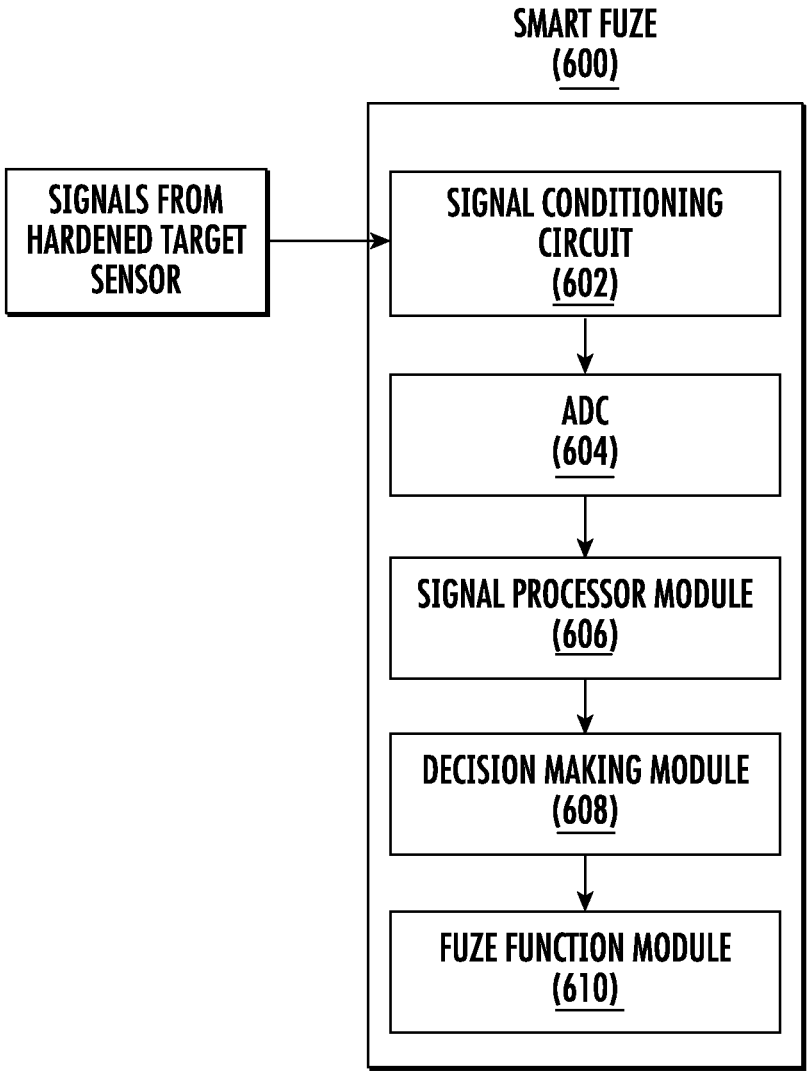
FIG. 6 is a block diagram of the smart fuze according to an implementation described herein.

FIG. 6 shows a block diagram of a smart fuze 600 according to an implementation described herein. This disclosure contemplates that the smart fuze 600 can be a component of the projectiles or hardened target sensors described above with regard to FIGS. 1A-4B. Smart fuze 600 includes a signal conditioning circuit 602, an analog-to-digital converter (ADC) 604, a signal processor module 606, a decision making module 608, and a fuze function module 610. The components of smart fuze 600 can be implemented using hardware, software, or combinations thereof. It should be understood that smart fuze 600 is only provided as an example, and that a smart fuze may include more or less circuits and/or modules than shown in FIG. 6. For example, this disclosure contemplates that the signal conditioning circuit 602 and/or analog-to-digital converter 604 may be separate and distinct components, i.e., a smart fuze may only include logic modules such as the signal processor module 606, decision making module 608, and fuze function module 610 shown in FIG. 6. As described above, the logical operations performed by the smart fuze 600 executed by a microprocessor.

Figure 2:
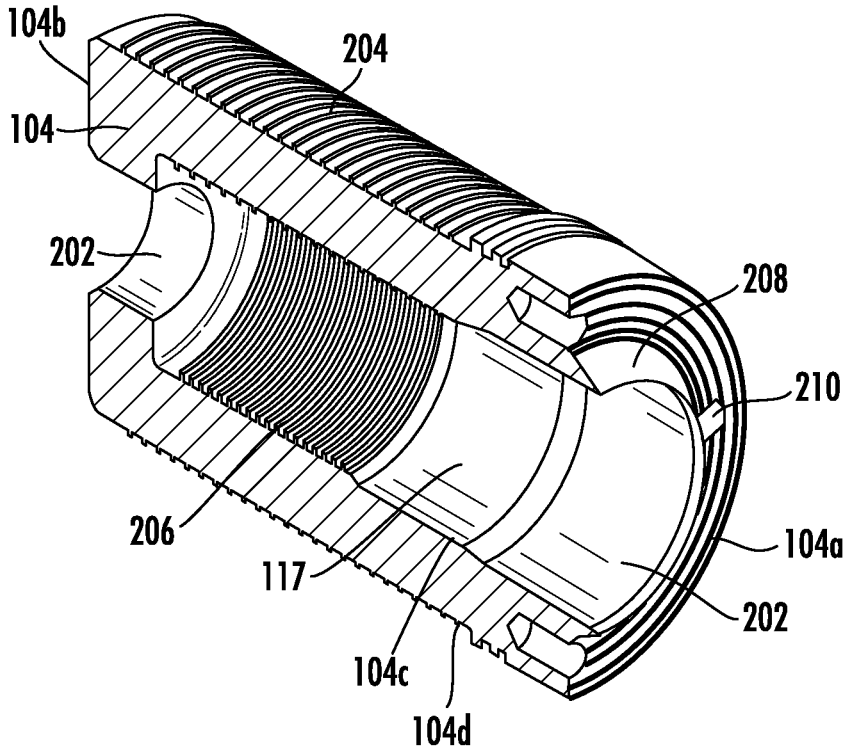
FIG. 2 shows a cutaway three-dimensional perspective view of a shroud of the hardened target sensor.

As shown in FIG. 6, the signal conditioning circuit 602 is operably connected to the hardened target sensor (e.g., hardened target sensor 100 of FIG. 1A). The signal conditioning circuit 602 receives one or more signals from strain gauges (e.g., strain gauges 110 of FIGS. 1A, 1B, 3A-4A) from the hardened target sensor. The signal conditioning circuit 602 is also operably connected to the analog-to-digital converter 604. The signal conditioning circuit 602 is configured to manipulate analog sensor signals (e.g., amplify, filter, adjust, etc.) before analog-to-digital conversion. Signal conditioning is known in the art and not described in further detail herein. The analog-to-digital converter 604 converts analog electrical signals from the strain gauges to digital signals. Analog-to-digital conversion is known in the art and not described in further detail herein. Following analog-to-digital conversion, the digitized sensor signals are processed by the signal processor module 606, the decision making module 608, and the fuze function module 610. The strain gauges, signal conditioning circuit 602, analog-to-digital converter 604, and signal processor module 606, the decision making module 608, and the fuze function module 610 can be coupled by one or more communication links. This disclosure contemplates that the communication link can be any suitable communication link. For example, a communication link can be implemented by any medium that facilitates data exchange including, but not limited to, wired, wireless, and optical links. Optionally, in some implementations, the fuze function module 610 can receive signals from an aircraft computer or other external computer, for example to control the smart fuze 600.

The digitized sensor signals are processed by the signal processor module 606. The signal processor module 606 analyzes the data contained in the digitized signals. For example, the signal processor module 606 a time-domain analysis or a frequency-domain analysis. Techniques for converting time domain signals into the frequency domain are known in the art and include, but are not limited to, a Fourier transform, a discrete Fourier transform, or a z-transform. This disclosure contemplates using any known technique for converting time domain signals into the frequency domain. The signal processor module 606 can be configured to determine a dynamic load acting on the projectile. This can include determining magnitude, location, and/or angle of the dynamic loading. Alternatively or additionally, the signal processor module 606 can be configured to detect an absence of the dynamic load acting on the projectile. Detecting presence or absence of dynamic loading can be accomplished, for example, by comparing the magnitude of the digitized signals to a threshold. Alternatively or additionally, the signal processor module 606 can be configured to detect compression and decompression cycles as the projectile passes through one or more hardened target layers.

The signal processor module 606 transmits the results of the analysis to the decision making module 608. The decision making module 608 is configured extract information from the results of the analysis. This can include, but is not limited to, counting a number of the one or more hardened layers through which the projectile passes and/or determining a type of material through which the projectile passes. For example, in some implementations, one or more characteristics of the analyzed digitized signals are compared to a library. The characteristics may be time domain (e.g., magnitude) or frequency domain characteristics. The library may include respective strain gauge impact data for a plurality of materials (e.g., hard target, void, or softer material such as sand, gravel, or water).

The decision making module 608 transmits information to the fuze function module 610. Such information can include, but is not limited to, the number of hardened target layers through which the projectile has passed and/or hardened target layer materials. The fuze function module 610 then determines, based on such information, whether to detonate the warhead. If the fuze function module 610 determines to detonate the warhead, the fuze function module 610 transmits a signal to the detonator.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A system, comprising:

a projectile defining an ogive, a body, and a base, wherein the body of the projectile is arranged between the ogive and the base;

a sensor assembly comprising a nose member and a plurality of strain gauges, wherein the nose member defines a nose portion and a shaft portion, and wherein the strain gauges are attached to the shaft portion;

a shroud member, wherein the shroud member is mechanically coupled with the sensor assembly and the body of the projectile; and a smart fuze arranged within the projectile, wherein the smart fuze is operably coupled to the strain gauges.

2. The system of claim 1, wherein the shaft portion is configured to compress in response to a load applied to the nose portion.

3. The system of claim 1, wherein the strain gauges are mounted to an external surface of the shaft portion.

4. The system of claim 1, wherein the strain gauges are arranged in a spaced apart relationship circumferentially around the shaft portion.

5. The system of claim 1, wherein the shroud member and the sensor assembly form a cavity therebetween, and wherein the strain gauges are arranged in the cavity.

6. The system of claim 5, further comprising a flexible sealing member configured to prevent debris and/or moisture present in an external environment from entering the cavity.

7. The system of claim 6, wherein the flexible sealing member is arranged in a gap between the shroud member and the sensor assembly.

8. The system of claim 6, further comprising at least one O-ring configured to prevent debris and/or moisture present in the external environment from entering the cavity.

9. The system of claim 1, wherein each of the strain gauges is individually addressable.

10. The system of claim 1, wherein the nose member comprises a channel configured to route an electrical connector between a strain gauge and the smart fuze.

11. The system of claim 1, wherein the sensor assembly comprises a set of strain gauges configured as a bridge circuit.

12. The system of claim 1, wherein the shroud member comprises a first bore.

13. The system of claim 12, wherein the nose member comprises a second bore.

14. The system of claim 13, wherein the smart fuze is arranged at least partially within the first bore and/or the second bore.

15. The system of claim 12, wherein the sensor assembly is arranged at least partially within the first bore.

16. The system of claim 12, wherein the shroud member comprises a first threaded portion disposed on an external surface of the shroud member and a second threaded portion disposed on an internal surface of the shroud member.

17. The system of claim 16, wherein the first threaded portion disposed on the external surface of the shroud member is configured to mechanically couple with a third threaded portion disposed on the projectile.

18. The system of claim 16, wherein the nose member further comprises a fourth threaded portion.

19. The system of claim 18, wherein the fourth threaded portion mechanically couples with the second threaded portion disposed on the internal surface of the shroud member.

20. The system of claim 1, wherein the smart fuze comprises a microprocessor, the microprocessor being configured to:

receive at least one signal detected by the strain gauges;

analyze the at least one signal detected by the strain gauges;

generate an actuation signal based, at least in part, on the analyzed at least one signal; and transmit the actuation signal to a detonator.

21. The system of claim 20, wherein analyzing the at least one signal detected by the strain gauges comprises a time-domain analysis or a frequency-domain analysis.

22. The system of claim 20, wherein analyzing the at least one signal detected by the strain gauges comprises determining a dynamic load acting on the projectile.

23. The system of claim 22, wherein analyzing the at least one signal detected by the strain gauges further comprises detecting an absence of the dynamic load acting on the projectile.

24. The system of claim 22, wherein analyzing the at least one signal detected by the strain gauges further comprises detecting compression and decompression cycles as the projectile passes through one or more hardened target layers.

25. The system of claim 24, wherein analyzing the at least one signal detected by the strain gauges further comprises counting a number of the one or more hardened layers through which the projectile passes.

26. The system of claim 20, wherein analyzing the at least one signal detected by the strain gauges comprises determining an angle of attack of the projectile.

27. The system of claim 20, wherein analyzing the at least one signal detected by the strain gauges comprises analyzing a frequency domain of the at least one signal to determine a type of material through which the projectile passes.

28. The system of claim 20, wherein the microprocessor is further configured to receive a respective signal detected by each of the strain gauges.

29. The system of claim 1, wherein the projectile is a munition.

* * * * *